US007832020B2

(12) United States Patent
Grilliot et al.

(10) Patent No.: US 7,832,020 B2
(45) Date of Patent: Nov. 16, 2010

(54) PROTECTIVE GLOVE HAVING DEAD AIR SPACE

(75) Inventors: William L. Grilliot, Dayton, OH (US); Mary I. Grilliot, Dayton, OH (US); Alan W. Schierenbeck, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 579 days.

(21) Appl. No.: 11/900,899

(22) Filed: Sep. 13, 2007

(65) Prior Publication Data

US 2009/0070909 A1 Mar. 19, 2009

(51) Int. Cl.
*A41D 19/00* (2006.01)

(52) U.S. Cl. ..... 2/161.1

(58) Field of Classification Search ..... 2/161.1, 2/161.6, 163
See application file for complete search history.

(56) References Cited

U.S. PATENT DOCUMENTS

| | | | | |
|---|---|---|---|---|
| 3,548,413 | A * | 12/1970 | Jackson | 2/16 |
| 6,055,670 | A * | 5/2000 | Parker | 2/161.1 |
| 6,427,250 | B1 | 8/2002 | Stull et al. | |
| 6,839,912 | B2 * | 1/2005 | Lewis | 2/161.6 |
| 2006/0156452 | A1 * | 7/2006 | Schierenbeck et al. | 2/161.6 |
| 2009/0222980 | A1 * | 9/2009 | Klug et al. | 2/455 |

* cited by examiner

*Primary Examiner*—Katherine Moran
(74) *Attorney, Agent, or Firm*—Wood, Phillips, Katz, Clark & Mortimer

(57) ABSTRACT

A protective glove (10) is provided for use by a firefighter or other emergency worker. The glove (10) includes an outer shell (22), at least one liner (24, 28, 30) located inside of the outer shell (22), and a dead air space (34) located inside of the outer shell (22).

16 Claims, 3 Drawing Sheets

PROTECTIVE GLOVE HAVING DEAD AIR SPACE

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to protective gloves for a firefighter, an emergency worker, or other first responder.

BACKGROUND OF THE INVENTION

It is typical for firefighters and/or emergency workers to wear a protective glove to protect the user's hands from burns, abrasions, and other injury that may occur in a hazardous environment. To this end, such protective gloves typically have an outer shell made of a suitable material, such as a suitable leather, such as cowhide or elk hide, or alternatively, a suitable fabric, such as Kevlar™ fabric or Nomax™ fabric. Commonly assigned U.S. Pat. No. 6,427,250 issued Aug. 6, 2002, provides further details for some examples of suitable material, and the entire specification is incorporated herein by reference. Furthermore, in fire emergency situations, such gloves protect the firefighter's or other emergency worker's hands from high temperatures and, often, against the water and/or chemicals that may be involved in such situations. To this end, such protective gloves will typically include a thermal insulation barrier in the form of a liner inside of a water/moisture barrier layer or liner, with both barriers being made from suitable materials, many of which are known. There is a continuing need to provide improvements in such gloves.

SUMMARY OF THE INVENTION

In accordance with one feature of the invention, a protective glove is provided for use by a firefighter or other emergency worker. The glove includes an outer shell, a moisture barrier layer inside of the outer shell, a thermal insulating liner inside of the moisture barrier layer, and a dead air space located inside of the outer shell, with the dead air space being maintained by structure provided between two surfaces of the glove.

In one feature, the dead air space is located between the moisture barrier layer and the thermal insulating liner.

As one feature, the dead air space is located between the outer shell and the moisture barrier layer.

According to one feature, the majority of the surfaces are spaced from each other to define the dead air space, one of the facing surfaces being an interior surface of the outer shell or the moisture barrier layer, and the other of the facing surfaces being an exterior surface of the moisture barrier layer or the thermal insulating liner.

As one feature, one of the outer shell, the moisture barrier layer, and the thermal insulating liner comprises a series of elongate ridges, the ridges engaged against an adjacent surface to maintain the dead air space, with the dead air space being maintained by structure provided between two surfaces of the glove.

In one feature, the moisture barrier layer is provided in the form of a moisture barrier liner.

According to one feature, the glove further includes at least one additional layer located inside of the outer shell.

In accordance with one feature of the invention, a protective glove is provided for use by a firefighter or other emergency worker. The glove includes an outer shell, at least one liner inside of the outer shell, and a dead air space located inside of the outer shell.

As one feature, the dead air space is located between the outer shell and the at least one liner.

In one feature, the majority of the surfaces are spaced from each to define the dead air space.

According to one feature, at least one of the outer shell and the at least one liner comprises a series of elongate ridges, the ridges engaged against an adjacent surface to maintain the dead air space.

In accordance with one feature of the invention, the ridges extend longitudinally.

According to one feature, each of the ridges includes a fold formed in the material of the one of the two liners. In a further feature, each of the folds has crease and a pair of side walls extending from the crease and attached to each other to retain the fold in the one of the two liners. In yet a further feature, the side walls are connected by stitching.

As one feature, each finger of the glove has one of the ridges extending the length of the finger.

According to one feature, the glove has a palm side and a back side, and the dead air space is limited to the back side.

Other objects, features, and advantages of the invention will become apparent from a review of the entire specification, including the appended claims and drawings.

DETAILED DESCRIPTION OF THE PREFERRED EMBODIMENT

Figure 1:
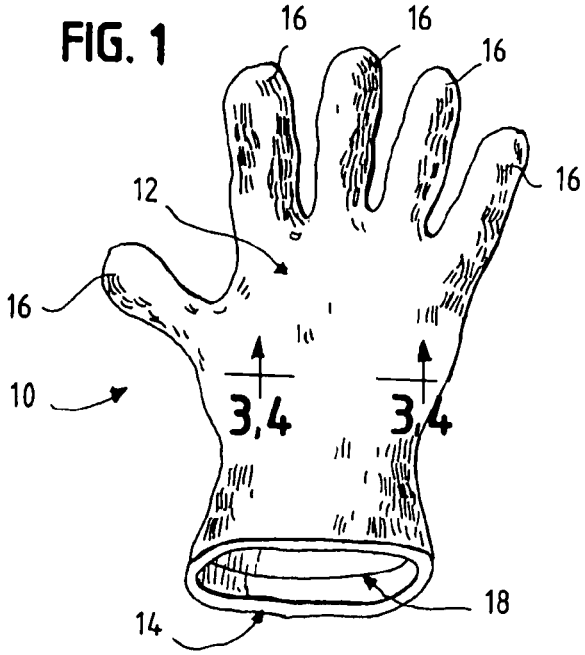
FIG. 1 is a perspective view from above of the back of a glove embodying the present invention.
Figure 2:
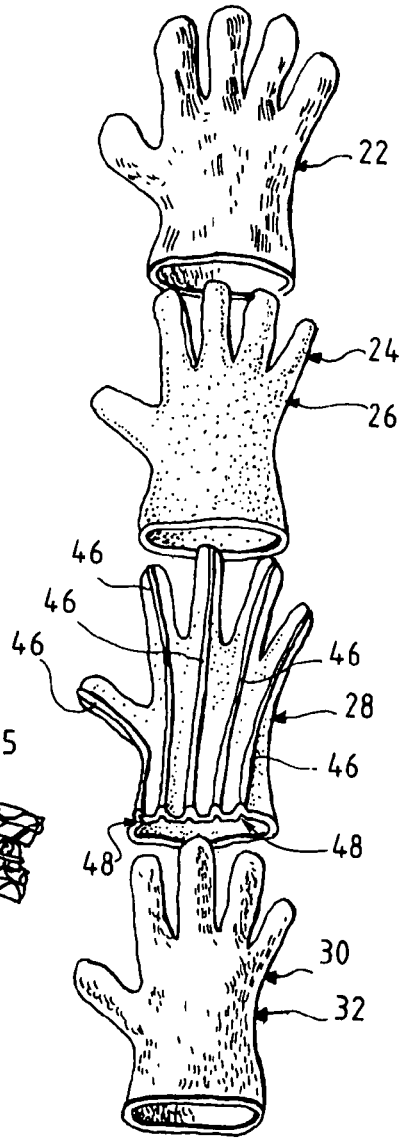
FIG. 2 is an exploded perspective view of the glove of FIG. 1.

With reference to FIGS. 1 and 2, a protective glove 10 is shown for use by a firefighter or other emergency worker. The protective glove 10 has a back face or side 12, a palm face or side 14 (facing the page in FIGS. 1 and 2), five fingers 16, and a hand receiving opening or cuff 18.

Figure 3:
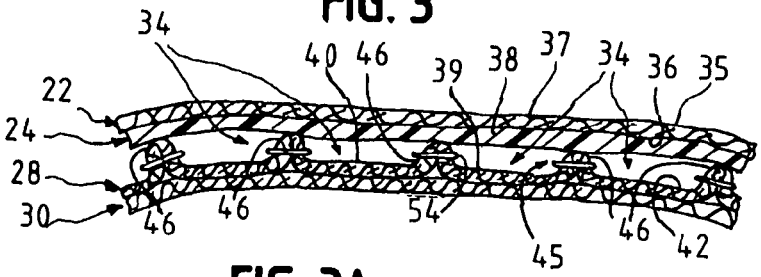
FIG. 3 is a partial section view of the back side of the glove of FIG. 1 taken along lines 3,4-3,4 in FIG. 1.

The protective glove 10 includes an outer shell 22, a moisture barrier layer 24 shown in FIGS. 1 and 2 as a moisture barrier liner 26 located inside of the outer shell 22, a thermal insulating liner 28 located inside of the moisture barrier 24, and an innermost layer 30 shown in FIGS. 1 and 2 as a liner 32 located inside of the thermal insulating liner 28. As shown in FIG. 3, the glove 10 further includes a dead air space 34 located inside of the outer shell 22 between the moisture barrier 14 and the thermal insulating liner 28.

The outer shell 22 may be made from any of the known suitable materials, such as those described in the background section of this application. The moisture barrier 24 may be made from any suitable material, many of which are known, such as Neoprene or Gore-Tex, or may be a suitable coating or fabric bonded as a layer to one of the other components of the glove, such as the outer shell 22 or the thermal insulating liner 28. The thermal insulating liner 28 may any suitable material, many of which are known, such as felt or the like, or preferably a "fluffy" or "lofty" type insulating material or fill.

Figure 3A:
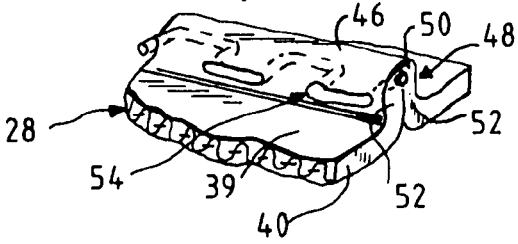
FIG. 3A is a perspective view of a thermal insulation liner shown in FIG. 3.

As best seen in FIG. 3, the outer shell has an exterior surface 35 and an interior surface 36, the moisture barrier 24 has an exterior surface 37 and an interior surface 38, the thermal insulating liner 28 has an exterior surface 39 and an interior surface 40, and the innermost layer 30 has an exterior surface 42 and an interior surface 44. For the configuration shown in FIG. 3, a majority of the interior and exterior surfaces 38 and 39 are spaced from each other to define the dead air space 34. In this regard, as seen in FIGS. 2 and 3, the thermal insulating liner 28 is provided with a structure 45 in the form of a series of elongate ridges 46 that engage against the interior surface 38 of the moisture barrier 24 to maintain the dead air space 34. The ridges 46 extend longitudinally with respect to the glove 10, and it is preferred that one of the ridges 46 extend the length of each of the fingers 16. Each ridge 46 is formed by providing a fold 48 in the material of the thermal insulating liner 28, with each of the folds 48 having a crease 50 and a pair of side walls 52 extending from the crease 50 and attached to each other to retain the fold 48 in the liner 24, as best seen in FIG. 3A. In this regard, in the illustrated embodiment, the walls 52 are attached to each other by a line of stitching 54 that extends the length of the ridge 46.

It should be understood that there are many possible options for the location of the dead air space 34 within the outer shell 22. For example, with reference to FIGS. 4 and 4A, the dead air space 34 is located between the thermal insulating liner 28 and the innermost liner 32, with the ridges 46 again being provided in the thermal insulating liner 28, but facing inwardly to engage against the innermost liner 32 to maintain the dead air space 34 rather than outwardly as in FIGS. 3 and 3A. Similar to the configuration of FIGS. 3 and 3A, a majority of the interior and exterior surfaces 40 and 42 are spaced from each other to define the dead air space 34.

Figure 5:
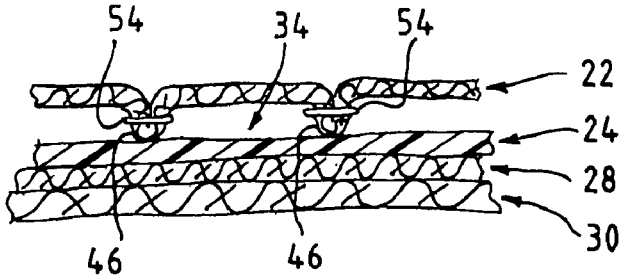
FIGS. 5-9 are views similar to FIGS. 3 and 4, but showing alternate embodiments of the invention.

Another alternative is shown in FIG. 5, wherein the dead air space 34 is provided between the outer shell 22 and the moisture barrier 24, with the ridges 46 being formed in the material of the outer shell 22 and extending inwardly to engage against the moisture barrier 24 to maintain the dead air space 34.

Figure 6:
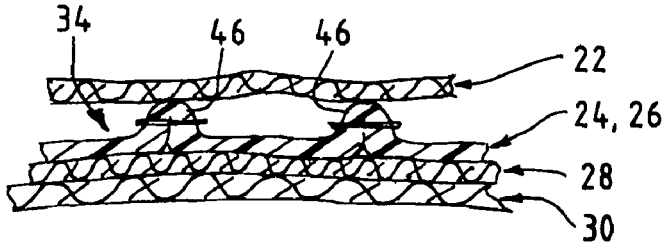

FIG. 6 shows yet another embodiment similar to that of FIG. 5, but having the ridges 46 being formed in the material of the moisture barrier 24 and extending outwardly to engage the outer shell 22 to maintain the dead air space 34.

Figure 7:
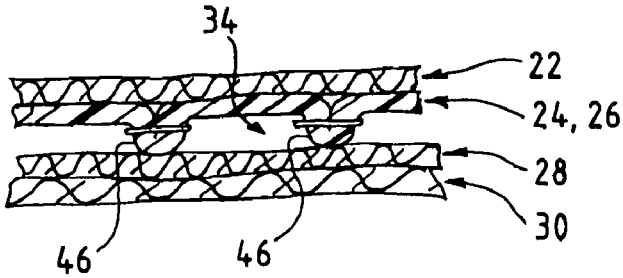

FIG. 7 shows another alternate embodiment wherein the dead air space 34 is provided between the moisture barrier 24 and the thermal insulating liner 28, similar to the configuration of FIGS. 3 and 3A, but with the ridges 46 formed in the material of the moisture barrier 24 and extending inwardly to engage against the thermal insulating liner 28 to maintain the dead air space 34.

Figure 4:
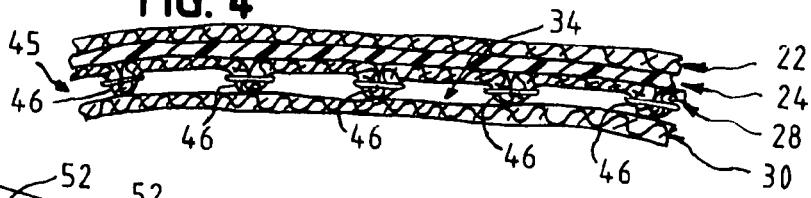
FIG. 4 is a view similar to FIG. 3 but showing an alternate embodiment.
Figure 4A:
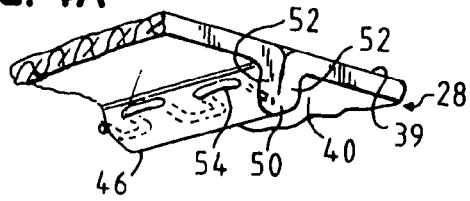
FIG. 4A is a view of a thermal insulation layer shown in FIG. 4.
Figure 8:
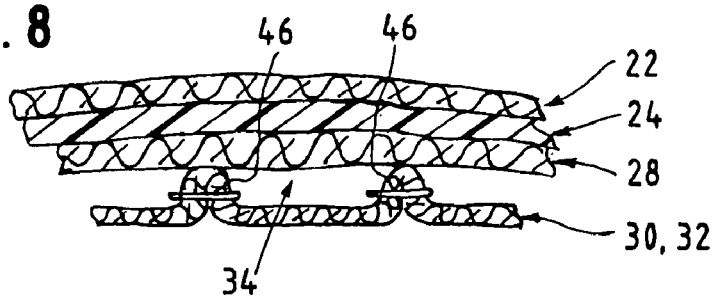

FIG. 8 shows yet another alternate embodiment wherein the dead air space 34 is located between the thermal insulating liner 28 and the innermost liner 32 similar to the configuration of FIGS. 4 and 4A, but with the ridges 46 being formed in the material of the innermost liner 32 and extending outwardly to engage the thermal insulating liner 28 to maintain the dead air space 34.

Figure 9:
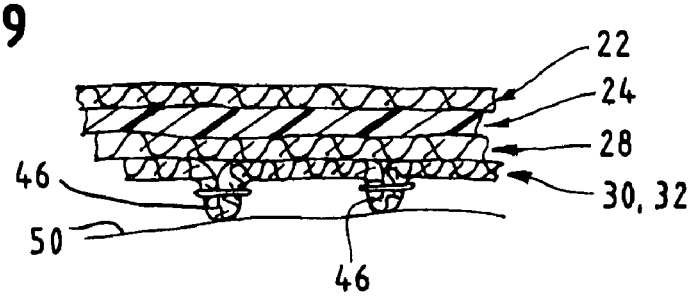

FIG. 9 shows a further alternate embodiment, wherein the ridges 46 are provided in the material of the innermost liner 32 extending inwardly to engage against the skin surface 50 of a wearer to create the dead air space 34 between the hand of the wearer and the innermost liner 32. In this regard, it should be appreciated that in some configurations of the glove 10, one or more of the various layers 24, 28 and 30 may be eliminated, and the ridges 46 can be provided extending inwardly from whatever layer 22, 24, 28 and 30 of the glove 10 that defines the innermost surface of the glove 10.

Figure 10:
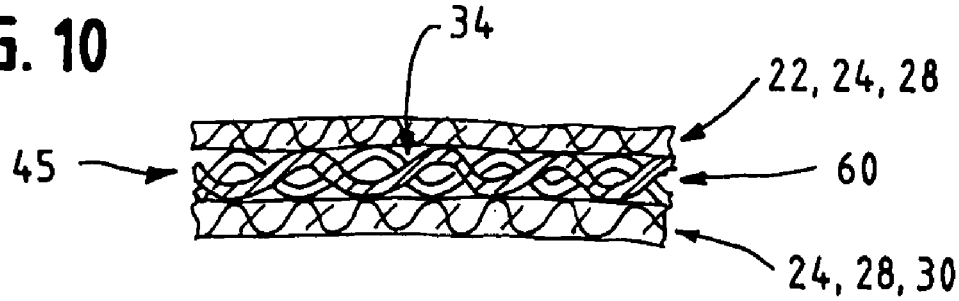
FIGS. 10-12 are views similar to FIGS. 5-9, but showing further alternate embodiments of the invention utilizing various structures to create a dead air space.
Figure 11:
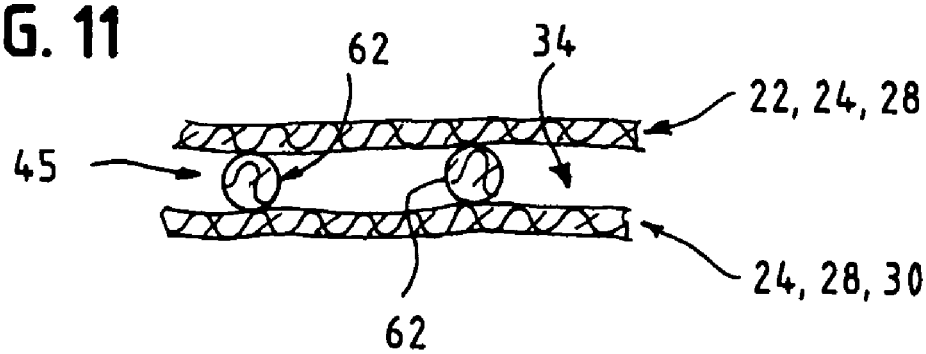
Figure 12:
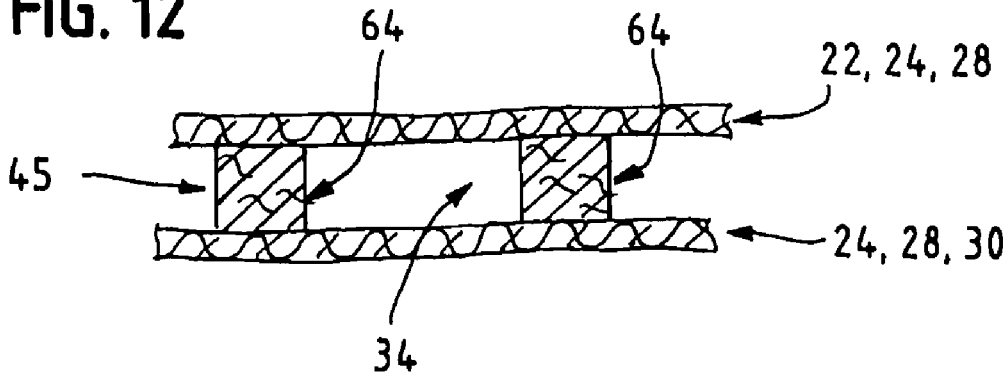

It should be appreciated that while for some applications of the glove 10 the use of the ridges 46 are preferred, in some applications it may be desirable to utilize other structures 45 to maintain the dead air space 34 between adjacent layers of the glove 10. For example, the dead air space 34 could be maintained between two adjacent layers 22, 24, 28, or 30 by utilizing a mesh 60 as shown in FIG. 10, one or more lengths of cord 62 as shown in FIG. 11, pads of material 64 as shown in FIG. 12, or any other suitable structure 45 that would maintain a separation between two adjacent layers so as to provide the dead air space 34. Furthermore, while it should be appreciated that it is preferred that a majority of the two facing surfaces that define the dead air space 34 be spaced from each other in each of the configurations, it should be understood that in some applications it may be desirable to have less than a majority of the two surfaces being spaced from each other, such as may be dictated by, for example, construction considerations for the glove 10. Additionally, while the illustrate embodiment shows five of the ridges 46 extending longitudinally, other orientations and/or other numbers of ridges 46 or other separating structure may be desirable depending upon the particular application and the particular structure used to maintain the dead air space 34.

The invention claimed is:

1. A protective glove for use by a firefighter or other emergency worker, the glove comprising:

an outer shell;

a moisture barrier layer inside of the outer shell;

a thermal insulating liner inside of the moisture barrier layer;

a dead air space located inside of the outer shell, the dead air space maintained by structure provided between two facing surfaces of the glove;

wherein one of the outer shell, the moisture barrier layer, and the thermal insulating liner comprises a series of elongate ridges, the ridges engaged against an adjacent surface to maintain the dead air space;

wherein each of the ridges comprises a fold;

wherein each of the folds has crease and a pair of side walls extending from the crease and attached to each other to retain the fold in the thermal insulating liner; and wherein each finger of the glove has one of the ridges extending the length of the finger.

2. The protective glove of claim 1 wherein the dead air space is located between the moisture barrier layer and the thermal insulating liner.

3. The protective glove of claim 1 wherein the dead air space is located between the outer shell and the moisture barrier layer.

4. The protective glove of claim 1 wherein the majority of the two surfaces are spaced from each other to define the dead air space, one of the facing surfaces being an interior surface of the outer shell or the moisture barrier layer, and the other of the facing surfaces being an exterior surface of the moisture barrier layer or the thermal insulating liner.

5. The protective glove of claim 1 wherein the ridges extend longitudinally.

6. The protective glove of claim 1 wherein the side walls are connected by stitching.

7. The protective glove of claim 1 wherein the glove has a palm side and a back side, and the dead air space is limited to the back side.

8. The protective glove of claim 1 wherein the moisture barrier layer is provided in the form of a moisture barrier liner.

9. The protective glove of claim 1 further comprising at least one additional layer located inside of the outer shell.

10. A protective glove for use by a firefighter or other emergency worker, the glove comprising:

an outer shell;

at least one liner inside of the outer shell;

a dead air space located inside of the outer shell, the dead air space maintained by structure provided between two facing surfaces of the glove;

wherein at least one of the outer shell and the at least one liner comprises a series of elongate ridges, the ridges engaged against an adjacent surface to maintain the dead air space;

wherein each of the ridges comprises a fold;

wherein each of the folds has crease and a pair of side walls extending from the crease and attached to each other to retain the fold in the thermal insulating liner; and wherein each finger of the glove has one of the ridges extending the length of the finger.

11. The protective glove of claim 10 wherein the dead air space is located between the outer shell and the at least one liner.

12. The protective glove of claim 10 wherein the majority of the two surfaces being spaced from each to define the dead air space.

13. The protective glove of claim 10 wherein the ridges extend longitudinally.

14. The protective glove of claim 10 wherein the side walls are connected by stitching.

15. The protective glove of claim 10 wherein the glove has a palm side and a back side, and the dead air space is limited to the back side.

16. The protective glove of claim 10 further comprising at least one additional layer located inside of the outer shell.

* * * * *